US008360352B1

(12) United States Patent
Moore

(10) Patent No.: US 8,360,352 B1
(45) Date of Patent: Jan. 29, 2013

(54) REEL FOR IMPROVED HANDLING OF LENGTHY FLEXIBLE MATERIALS SUCH AS ELECTRICAL CORDS, AND THE LIKE

(76) Inventor: Sidney D. Moore, Comanche, TX (US)

( * ) Notice: Subject to any disclaimer, the term of this patent is extended or adjusted under 35 U.S.C. 154(b) by 0 days.

(21) Appl. No.: 13/342,183

(22) Filed: Jan. 2, 2012

(51) Int. Cl.
*B65H 75/38* (2006.01)

(52) U.S. Cl. ..... 242/388.1; 242/395; 242/402; 242/405.3; 242/613

(58) Field of Classification Search ..... 242/378, 242/378.1, 378.2, 378.3, 388, 388.1, 388.5, 242/395, 402, 405, 405.1, 405.2, 405.3, 579, 242/588, 588.2, 613, 125, 125.1, 127, 129
See application file for complete search history.

(56) References Cited

U.S. PATENT DOCUMENTS

| | | | | | |
|---|---|---|---|---|---|
| 677,993 | A * | 7/1901 | Jones | 242/388.5 |
| 972,222 | A * | 10/1910 | Paul | 242/388.1 |
| 1,536,383 | A * | 5/1925 | French | 254/373 |
| 1,568,743 | A * | 1/1926 | Kitto | 242/388.5 |
| 2,952,420 | A | 10/1956 | Von Hoorn | |
| 3,840,713 | A | 10/1974 | Carpentier | |
| 4,072,278 | A * | 2/1978 | Petersen | 242/388.4 |
| 4,390,142 | A * | 6/1983 | Cheng | 242/388.1 |
| D314,910 | S | 2/1991 | VanSkiver | |
| D359,440 | S | 6/1995 | Stewart | |
| D408,720 | S | 4/1999 | Sheng | |
| 5,992,787 | A | 11/1999 | Burke | |
| 7,546,969 | B2 * | 6/2009 | Kuramoto | 242/388.1 |
| 7,984,798 | B1 | 7/2011 | Hall | |
| 2008/0197230 | A1 * | 8/2008 | Namba | 242/579 |

* cited by examiner

*Primary Examiner* — William E Dondero

(57) ABSTRACT

A reel for the management, transport, and storage of flexible materials such as electrical cords, air hoses, and the like, comprises a hollow cylindrical central hub with a pair of disk-like side plates radially attached to the outer ends of the hub, a slidable hand grip mounted on said reel and a rotatable winding knob for controllable rotation of the reel by an operator. The cord take-up portion of the hub has a provisional retainer shaped to receive a loop formed, preferably, in the middle of the cord's length. Once the loop is hooked over the provisional retainer, an operator reels in both halves of the cord simultaneously by turning with the winding knob. Conversely, holding the reel by the slidable hand grip with one hand and pulling outward on both ends of the cord simultaneously with the free hand, unreels the cord as needed. Once the cord is fully unwound from the hub, the provisional retainer allows it to falls free of the reel for unfettered use.

10 Claims, 5 Drawing Sheets

REEL FOR IMPROVED HANDLING OF LENGTHY FLEXIBLE MATERIALS SUCH AS ELECTRICAL CORDS, AND THE LIKE

BACKGROUND OF THE INVENTION

The prior art is replete with novel means to manage electrical cords and other lengthy flexible materials such as hoses and cables. Except for necessarily complex systems for industrial applications, such as the structure taught in U.S. Pat. No. 3,840,713, issued to Carpentier, a vast number of these devices are overly elaborate structures which, on their faces, appear to be clever and effective solutions to the age-old problem of cord management. Exemplary of the prior art of this category are U.S. Pat. Nos. 2,952,420 issued to Von Hoorn; U.S. Pat. No. 4,390,142 issued to Cheng; and, U.S. Pat. No. 5,992,787, issued to Burke; and, U.S. Pat. No. 7,984,798 B1, issued to Hall.

Unfortunately, these devices require many stages and operations in their manufacture, resulting in great expense for the manufacturer in materials, tooling, and labor, the added costs of which are passed on to the consumer in the form of higher prices. In addition, these devices sacrifice simplicity of structure and operation to produce their questionable advantages. For instance, it is a characteristic of this class of cord managing devices to fold, or bend, the cord sharply in order to make it comply with the requirements of the device. In the case of cords that carry electrical current, this is extremely bad practice and can lead to overheating, failure of the cord, and, in worst-case scenarios, fire and electrocution. However, operationally, there is another major disadvantage in these devices: the electrical cord is captured within them and must remain encumbered by the device at all times. Only in the extreme situation would it be advantageous for the operator to fully remove the cord from the device for unrestricted use.

Another disadvantage of devices of this class of prior art is complete disengagement of the cord from the device requires the performance of a number of annoying, and time consuming, manipulations.

There are, however, other prior art devices that are more elegant in their simplicity and more straightforward in their functionality. Devices of this class of cord management tools are typified by their low costs of manufacture and general ease of use. Examples include U.S. Pat. No. Des. 314,910, issued to VanSkiver; U.S. Pat. No. Des. 359,440, issued to Stewart; and, U.S. Pat. No. Des. 408,720, issued to Sheng. Each of the first two patents features two means for fastening an end of an electrical cord to the device for winding upon a hub: a hook to capture an end of the cord, located within the cord winding area next to the hub and one, or more, keyhole-shaped receptacles let into a side plate of the device for retaining a cord end. These devices exemplify simplicity and general usefulness and are the basis upon which the present invention is an improvement. However, these prior art devices also have disadvantages which will be discussed later in this specification.

BRIEF DESCRIPTION OF THE DRAWINGS

For a more complete understanding of the present invention and the objects and advantages thereof, reference is now made to the following brief descriptions taken in connection with the accompanying drawings in which.

DESCRIPTION OF PERTINENT PRIOR ART

Figure 1:
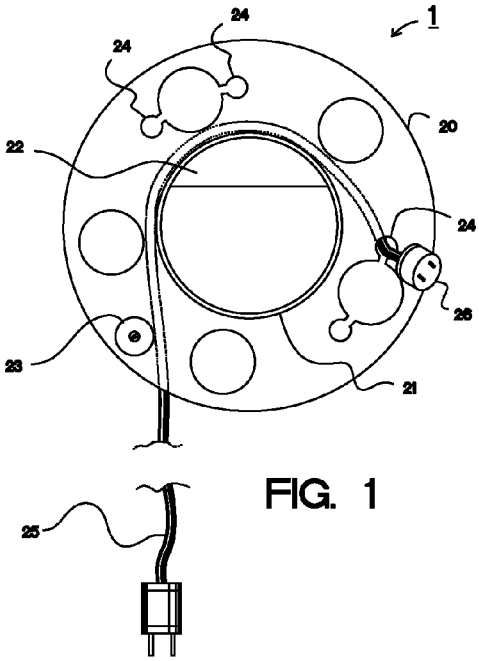
FIGS. 1 and 2 show relevant examples of pertinent prior art.
Figure 2:
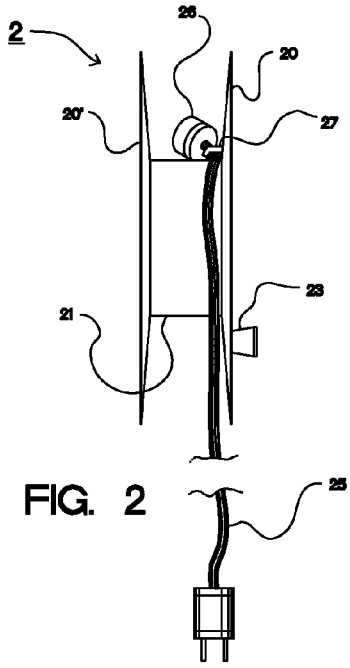
FIG. 2 PRIOR ART

An understanding of the present invention and its advantages over the prior art can best be understood with reference now to examples of the prior art shown in FIGS. 1 and 2.

FIG. 1 shows a cord reel 1 of the prior art comprising a hollow cylindrical central hub 21 from which a pair of disk-like side plates 20 and 20'(the latter, not shown) extends radially from the ends thereof. The reel carries a slidable hand grip 22, and a winding knob 23. At least one side plate 20 or 20' has one, or more, keyhole-shaped openings 24 through which an end 26 of an electrical cord 25 may be secured, as shown, for subsequent winding upon hub 21 for transport and storage.

Cord reels of this type are inexpensive and serviceable and are typified by a product currently available from Bayco Products, Wylie, Tex., U.S.A., and shown in the following internet link: http://bit.1y/sVU2wz. However, these reels exhibit two primary disadvantages with regard to utility. Upon the winding of a cord onto the apparatus, an operator may easily mistake cord end 26 for winding knob 23, thus, introducing strain to the connection of end 26 to cord 25. Another primary disadvantage is that cord 25 is wound onto the reel in a single, continuous, strand and must be completely unwound from the device for serviceable use. Otherwise, the cord is of very limited service when left partially wound upon hub 21.

The prior art shown in FIG. 2 is very similar to that of FIG. 1 in that a reel 2 is fitted with a pair of opposing side plates 20 and 20' integral to a hollow cylindrical central hub 21, a slidable hand grip (not shown), and a winding knob 23. Instead of, or, in addition to, keyhole-shaped openings 24, the device has a hook 27 mounted on the inside face of side plate 20 in close proximity to the cord-winding surface of hub 21. An operator hooks an end 26 of electrical cord 25 under hook 27 and, grasping knob 23 with one hand while supporting device 1 with the other hand by means of the slidable hand grip, winds the entire length of the cord in a single, continuous, strand onto hub 21 for transport and storage.

Both of these classes of the prior art share the major disadvantage of being capable of winding and unwinding an electrical cord as a single, continuous, strand for its entire length. Thus, in the case of a 100' long cord, the entire 100 feet must be reeled in, and out, for the cord to be of use even though the amount needed for a particular job might be only twenty feet.

These several disadvantages and shortcomings of the prior art are addressed and cured by the teachings of the present invention. For instance, as will be understood from the following description of the preferred embodiment, the instant invention requires that only ten feet of combined cord length be dispensed from the fully-loaded reel to provide twenty feet of serviceable cord. And, when the full length of the electrical cord—free of the encumbrance of the reel—is desired, only fifty feet of combined cord need be dispensed before the entire cord falls free of the reel for unfettered use. And, in this example of use, once the job is completed, the cord is readily returned to the reel by the forming of a loop at the cord's center, placing it over a protrusion provided by the novel retainer, and reeling in the fifty feet of doubled cord.

These, and other, advantages of the instant invention will be better appreciated from a consideration of the following description of a preferred embodiment

DESCRIPTION OF THE PREFERRED EMBODIMENT

Figure 3:
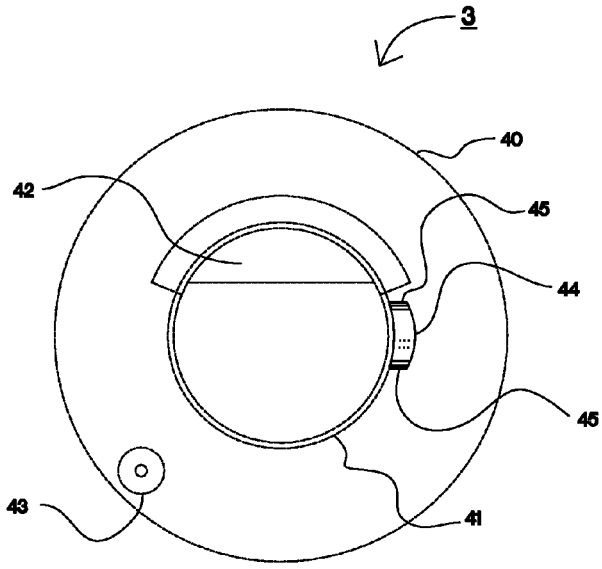
FIG. 3 is a phantom side view of an electrical cord reel fitted with a preferred embodiment of the instant invention.
Figure 4:
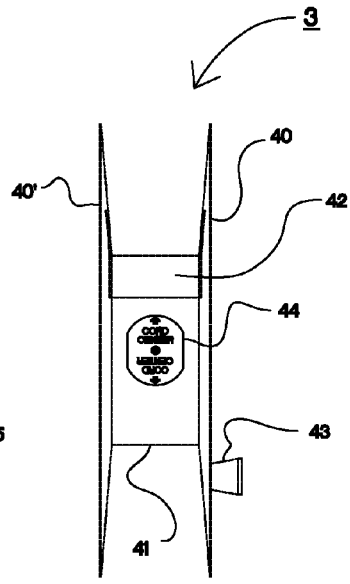
FIG. 4 is a phantom end view of the reel shown in FIG. 3 showing the preferred embodiment of the instant invention in its relationship to the reel.

FIGS. 3 and 4 illustrate, in phantom view, a preferred embodiment 3 of the present invention having a pair of opposing disk-like side plates 40 and 40' depending from a hollow cylindrical central hub 41, a slidable hand grip 42 and a winding knob 43. In addition to these elements, all old in the art, is novel retainer 44, mounted on, or molded into, the winding surface of hub 41 and spaced equidistant axially between side plates 40 and 40' as better shown in FIG. 4. Novel retainer 44 serves to secure a cord for the initial stage of winding upon hub 41 as will be better understood with reference to FIG. 5.

Figure 5:
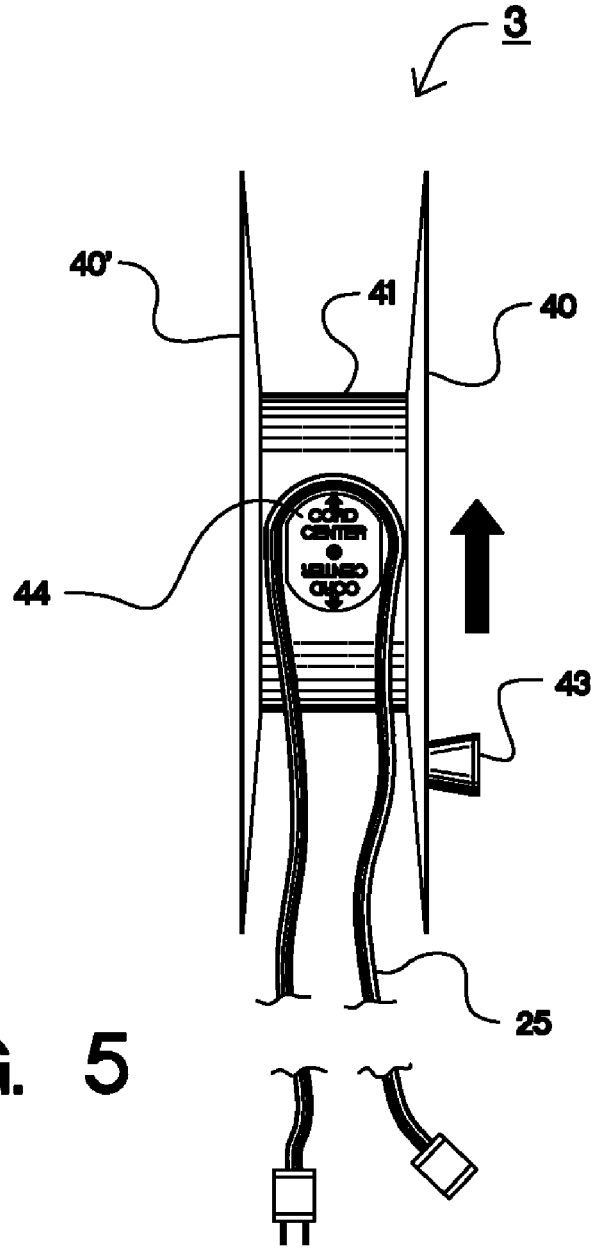
FIG. 5 is an end view of the reel of FIGS. 3 and 4 showing the relationship of a reel embodying the present invention to an electrical cord to be wound thereupon.

FIG. 5 shows a preferred embodiment 3 of the present invention with an electrical cord 25 looped at the center of its length over one of protrusions 45 (shown in FIG. 3) provided by novel retainer 44, ready for winding upon hollow cylindrical central hub 41. In use, an operator forms a loop at the center of the length of an electrical cord and places it over novel retainer 44, as shown in FIG. 5. After the cord is secured at retainer 44, as shown, side plates 40 and 40' act in concert with retainer 44 to maintain engagement of the cord during the initial winding process. Supporting the reel with the left hand grasping slidable hand grip 42 (not shown in this drawing) and grasping winding knob 43 with the right hand, the operator turns the reel in the direction of the arrow to wind the cord onto hub 41. The remainder of the cord is subsequently wound onto hub 41 by continued turning of winding knob 43 in the direction of the arrow. It is to be noted that, in addition to winding with the right hand in the direction indicated by the arrow, the novel device also accommodates winding with the left hand in the opposite direction. It will be appreciated that, in the instant invention, complete winding of the entire cord is accomplished with half the effort and time of prior art devices which require the full length of the cord to be wound as an individual, single, strand.

Figure 6:
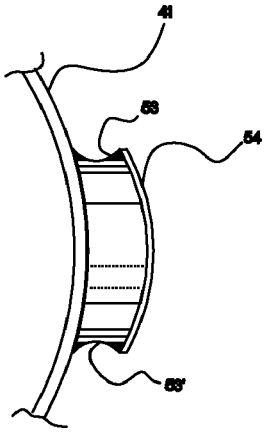
FIG. 6 is a partial view of the reel of FIGS. 3 and 4 having an alternative cord retainer.
Figure 7:
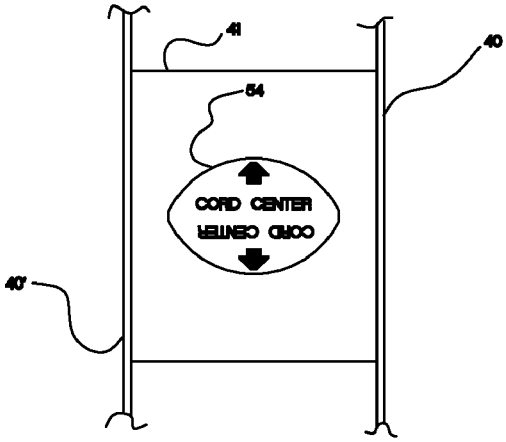
FIG. 7 is a partial view of the reel of FIGS. 3 and 4 showing yet another alternative embodiment of the present invention.

FIGS. 6 and 7 show, in partial views, two further examples of the form the retainer may assume. In FIG. 6, alternative retainer 54 is similar to retainer 44 of FIGS. 3, 4 and 5 with the exception that, instead of having essentially vertical sides, retainer 54 has concave sides 53 and 53'.

The novel retainer 54 shown in FIG. 7 is yet another example of the variety of form the novel retainer of the present invention may take. Alternative retainer 54 is disposed on hub 41 equidistant between side walls 40 and 40'.

Figure 8:
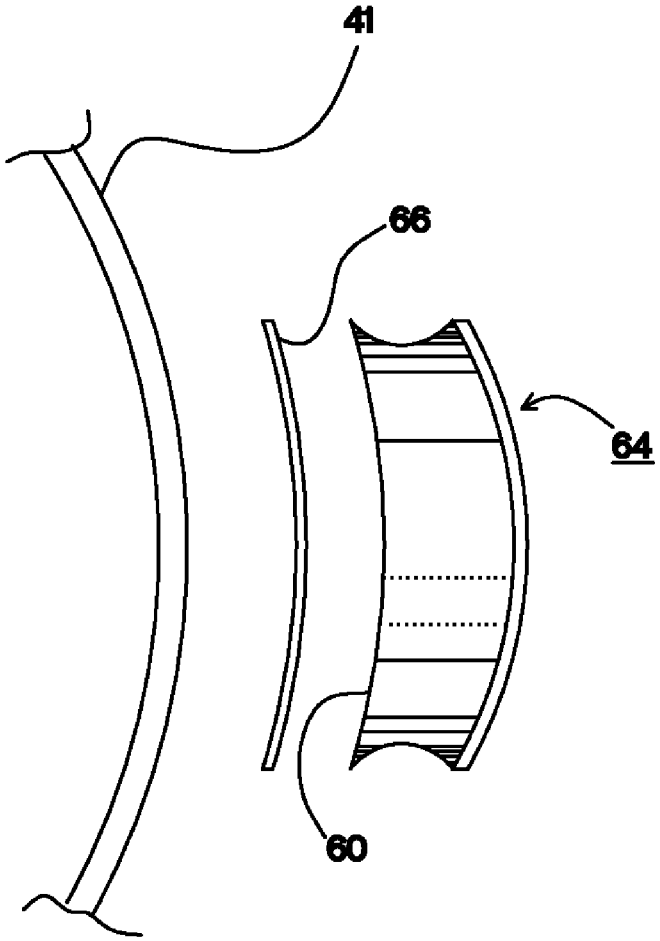
FIG. 8 is a partial view of the hub of an existing cord reel showing its relationship to a retrofit embodiment of the present invention.

FIG. 8 shows a partial view of hub 41 of a prior art reel similar to those shown in FIGS. 1 and 2 and its relationship to retainer 64, a retrofitable embodiment of the present invention, and adhesive interface 66 for attaching retainer 64 to hub 41. Adhesive interface 66 may be pre-applied to face 60 of retainer 64 during manufacture and provided with a protective peel-off cover of waxed paper, or the like, to be removed just prior to affixing the retainer to the hub of the existing cord reel.

It is to be noted that, unlike reels of the prior art, an operator may start the winding process at the center of the cord's length rather than at one of its extreme ends. This simple improvement yields a number of surprising and desirable results while eliminating all the limitations of the prior art. Most importantly, the present invention allows an operator to "pull off", or, unwind, only the amount of cord immediately needed for a particular task. In unwinding the cord, both ends are grasped by the operator and dispensed together. Thus, the combined length of cord wound, and subsequently dispensed, is half that of the prior art resulting in greater efficiency and much improved cord management and convenience.

Another advantage of the instant invention when the retainer is formed with either essentially vertical or concave sides as shown in the drawings, is that, upon full extension, the cord will simply fall free of the device, thus, making it fully available for immediate use.

Another advantage of the instant invention is the novel cord retainer may be so shaped as to provide equally efficient cord winding in either direction of rotation of the reel.

Yet another advantage of the present invention is the entire cord, including both ends thereof, are wound together for transport and storage, safely ensconced within the protection provided by the side plates, leaving no segment of the cord protruding from the sides to risk damage thereto.

It is to be appreciated that the preceding description of a preferred embodiment is illustrative and not meant to limit the scope of the appended claims. For instance, the novel retainer might, instead, be formed as a negative indentation in the surface of the cylindrical hub. Similarly, a reel with winding means other than a rotatable knob is to be understood to be within the scope of the instant invention. Similarly, the retainer might be molded integral to the hub or be entirely separate and attached thereto by secondary means such as screws, glue, heat-bonding, or, by any other suitable means.

In addition, it is to be further understood that the instant invention is equally adaptable to reels of the type with an axle, a supporting frame, and a crank for turning the reel such as taught by the cited reference, U.S. Pat. No. 7,984,798 B1, issued to Hall.

Finally, the retainer of the instant invention may be provided as a retrofit product for attachment to the hub of an existing cord reel by one of a number of suitable fastening means. For instance, the retrofit retainer may be provided with an adhesive at its interface surface for attachment to the hub.

One skilled in the art will recognize that other embodiments and improvements are within the scope and spirit of the present invention. Thus, the scope of the present invention is to be determined solely by the scope of the appended claims.

I claim:

1. Apparatus for winding, transporting, and storing a length of flexible material, comprising;

a hub, a pair of side plates extending radially from the axial ends of said hub, means for turning said hub, means for supporting said apparatus during the use thereof; wherein, the improvement comprises, an oblong protrusion extending radially from said hub and having a thickness approximately equal to an outer diameter of said flexible material, the protrusion adapted to provisionally engage and retain a loop formed in said length of flexible material at a point along the length thereof for winding said length of flexible material upon said hub to facilitate the transport, storage, and use thereof, whereby said length of said flexible material is secured upon said hub by virtue of the buildup of layers of said flexible material as it is wound onto said hub and, subsequently, is instantaneously and automatically released upon the full unwinding of said flexible material from said hub for use unfettered by the encumbrance of said apparatus.

2. The apparatus of claim 1, wherein said protrusion to provisionally engage and retain a loop formed in said length of said flexible material defines a retainer integral to said hub.

3. The apparatus of claim 1, wherein said protrusion to provisionally engage and retain a loop formed in said length of said flexible material defines a retainer separate from said hub and attached thereto by secondary fastening means.

4. The apparatus of claim 1 wherein said protrusion has a continuous, generally curved, surface.

5. The apparatus of claim 1 wherein said protrusion to provisionally engage and retain said length of flexible material defines a retainer positioned on said hub to receive a loop formed proximate the center of the length of said flexible material for subsequent winding of both halves of said length simultaneously upon said hub.

6. A reel for winding, transporting, and storing a length of flexible material; comprising:

a hub, a pair of side plates extending radially from the axial ends of said hub, a winding knob attached to one of said side plates for use in turning said reel; and, a hand grip mounted on said hub to support said reel during the winding thereof; wherein the improvement comprises, an oblong protrusion extending radially from said hub and having a thickness approximately equal to an outer diameter of said flexible material, the protrusion adapted to provisionally engage and retain a loop formed in said length of flexible material at a point along the length thereof for winding said length of flexible material upon said hub to facilitate the transport, storage, and use thereof, whereby said length of said flexible material is secured upon said hub by virtue of the buildup of layers of said flexible material as it is wound onto said hub and, subsequently, is instantaneously and automatically released upon the full unwinding of said flexible material from said hub for use unfettered by the encumbrance of said reel.

7. The reel of claim 6 wherein said protrusion to provisionally engage and retain a loop formed in said length of said flexible material defines a retainer integral to said hub.

8. The reel of claim 6 wherein said protrusion to provisionally engage and retain a loop formed in said length of said flexible material defines a retainer separate from said hub and attached thereto by secondary fastening means.

9. The reel of claim 6 wherein said oblong protrusion has a continuous, generally curved, surface.

10. The reel of claim 6 wherein said protrusion to provisionally engage and retain said length of flexible material defines a retainer positioned on said hub to receive a loop formed proximate the center of the length of said flexible material for subsequent winding of both halves of said length simultaneously upon said hub.

* * * * *